US005367809A

United States Patent [19]

Ross

[11] Patent Number: 5,367,809

[45] Date of Patent: Nov. 29, 1994

[54] EASY IDENTIFICATION OF SOCKS

[75] Inventor: Eugene B. Ross, Laurens, S.C.

[73] Assignee: Walk-Winn Plastics Co., Inc., Little Rock, Ak.

[21] Appl. No.: 78,455

[22] Filed: Jun. 16, 1993

[51] Int. Cl.[5] ..... G09F 3/12

[52] U.S. Cl. ..... 40/668; 24/DIG. 29

[58] Field of Search ..... 40/302, 668; 24/DIG. 29

[56] References Cited

U.S. PATENT DOCUMENTS

| | | | |
|---|---|---|---|
| 739,766 | 9/1903 | White . | |
| 970,529 | 9/1910 | Miller | 40/668 |
| 1,188,910 | 6/1916 | Derrett | 40/302 |
| 1,701,770 | 2/1929 | Canine . | |
| 1,723,011 | 8/1929 | Busco . | |
| 1,930,634 | 10/1933 | Weiss | 40/668 |
| 2,302,341 | 11/1942 | Nash | 24/245 |
| 2,590,883 | 4/1952 | Nierhaus | 40/3 |
| 2,663,877 | 12/1953 | Bohman | 2/239 |
| 2,785,413 | 3/1957 | Cook | 2/240 |
| 2,881,766 | 4/1959 | Tornsjo | 129/16.8 |
| 3,177,550 | 4/1965 | Borgeson | 24/245 |
| 3,699,617 | 10/1972 | Hofmeister | 24/81 GS |
| 4,058,853 | 11/1977 | Boxer et al. | 2/239 |
| 4,149,329 | 4/1979 | Graves | 40/668 |
| 4,165,555 | 8/1979 | Boxer et al. | 24/204 |
| 4,198,772 | 4/1980 | Furutu | 40/302 |
| 4,734,938 | 4/1988 | Anderson | 2/239 |
| 4,982,519 | 1/1991 | Hans | 40/666 |
| 5,038,413 | 8/1991 | Ursino | 2/239 |
| 5,114,187 | 5/1992 | Branch | 283/81 |

FOREIGN PATENT DOCUMENTS

| | | | |
|---|---|---|---|
| 0589107 | 11/1933 | Germany | 40/302 |
| 0636915 | 3/1962 | Italy | 40/302 |

*Primary Examiner*—Edward K. Look
*Assistant Examiner*—Mark Sgantzos
*Attorney, Agent, or Firm*—Leonard Bloom

[57] ABSTRACT

An identifying device for affixation to laundry items and to further identify an owner of the laundry items. The identifying device is a one piece unit which has a first end and an opposite second end. The first end has a male member formed thereon and the second end has a female member formed thereon. The one piece unit is hinged between the first end and the second end so that the one piece unit may be folded over the laundry item. The male member of the device is irremovably connected to the laundry item by pushing the male member through the laundry item and joining the male member with the female member. Indicia means are formed on the device to permit identification and matching of pairs of laundry items.

2 Claims, 3 Drawing Sheets

EASY IDENTIFICATION OF SOCKS

FIELD OF THE INVENTION

The present invention relates to an identifying device and more particularly to an identifying device to be used with laundry items to permit proper pairing of the laundry items and to identify the owner of the laundry items.

BACKGROUND OF THE INVENTION

It is difficult to sort out laundry items, especially socks to get them paired off properly, following washing and drying. Also, the socks may get mixed up in a dresser drawer; for example, it is not unusual to mismatch black with navy blue, which causes some degree of embarrassment. Besides color, it is sometimes difficult to match pairs of socks according to texture, material or size.

This problem has been recognized and the applicant is aware of the following U.S. Letters Patent which are related thereto:

| U.S. Pat. No. | Patentee |
|---|---|
| 739,766 | White |
| 1,701,770 | Canine |
| 1,723,011 | Busco |
| 2,302,341 | Nash |
| 2,590,883 | Nierhaus |
| 2,663,837 | Bohman |
| 2,785,413 | Cook |
| 2,881,766 | Tornsjo |
| 3,177,550 | Borgeson |
| 3,699,617 | Hofmeister |
| 4,058,883 | Boxer et al |
| 4,165,555 | Boxer et al |
| 4,734,938 | Anderson |
| 4,982,519 | Hans |
| 5,038,413 | Ursenio |
| 5,114,187 | Branch |

The uses of laundry tape has been known for over sixty-five years and clasps for clothing has been known for over ninety years but none of the known approaches have received acceptance by the public. The reasons are many, some of the approaches require sewing or knitting during manufacture of the laundry items; others are to join mated pairs together and are not simply for identification; still others are uncomfortable to the wearer.

Thus, a need exists for an economical, simple identification device for laundry items which can be affixed to the laundry items by a user and which is comfortable when worn.

SUMMARY OF THE INVENTION

An object of the present invention is to provide a simple, economical identifying device which can be easily affixed to laundry items and include an indicia means formed on the device.

Another object of the present invention is to provide visual means on the identifying device to enable a user to identify the owner of the laundry item and to match pairs of laundry items.

Still another object of the present invention is to provide an identifying device which is irremovably attached to the laundry item and is comfortable when the laundry item is worn.

In accordance with the teachings of the present invention, there is described herein an identifying device for laundry items, such as socks, to permit proper pairing of the laundry items and to further identify an owner of the laundry items. The device is a one piece unit having a first end and an opposite second end. The first end has formed thereon a male member and the second end has formed thereon a female member. The one piece unit is hinged between the first end and the second end whereby the one piece unit may be folded over the laundry item. The male member has a shaft having a cross section. A first end of the shaft is connected to the first end of the unit and a second end of the shaft is distal from the first end of the unit. The second end of the shaft has an enlarged portion formed thereon and the female member has an opening formed therein. The opening in the female member is smaller than the enlarged portion of the shaft, wherein the enlarged portion of the shaft may be forced through the laundry items and through the opening to irremovably join the male men%her to the female member. The one piece unit further has indicia means formed thereon to permit identification by the owner of the laundry item and to permit visual matching of pairs of laundry items.

These and other objects of the present invention will become apparent from a reading of the following specification, taken in conjunction with the enclosed drawings.

DESCRIPTION OF THE PREFERRED EMBODIMENT

Figure 1:
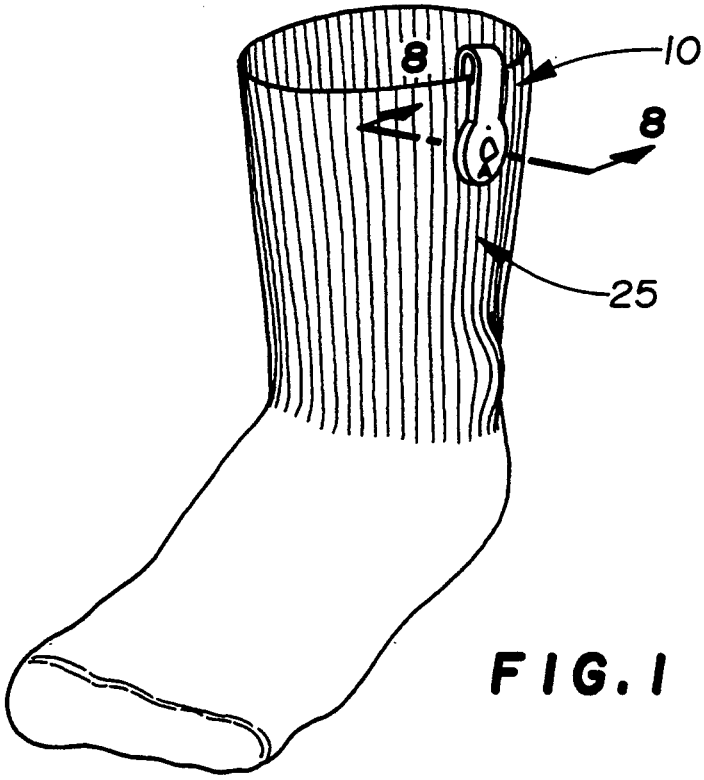
FIG. 1 is a perspective view of the present invention worn on the sock by an individual.
Figure 2:
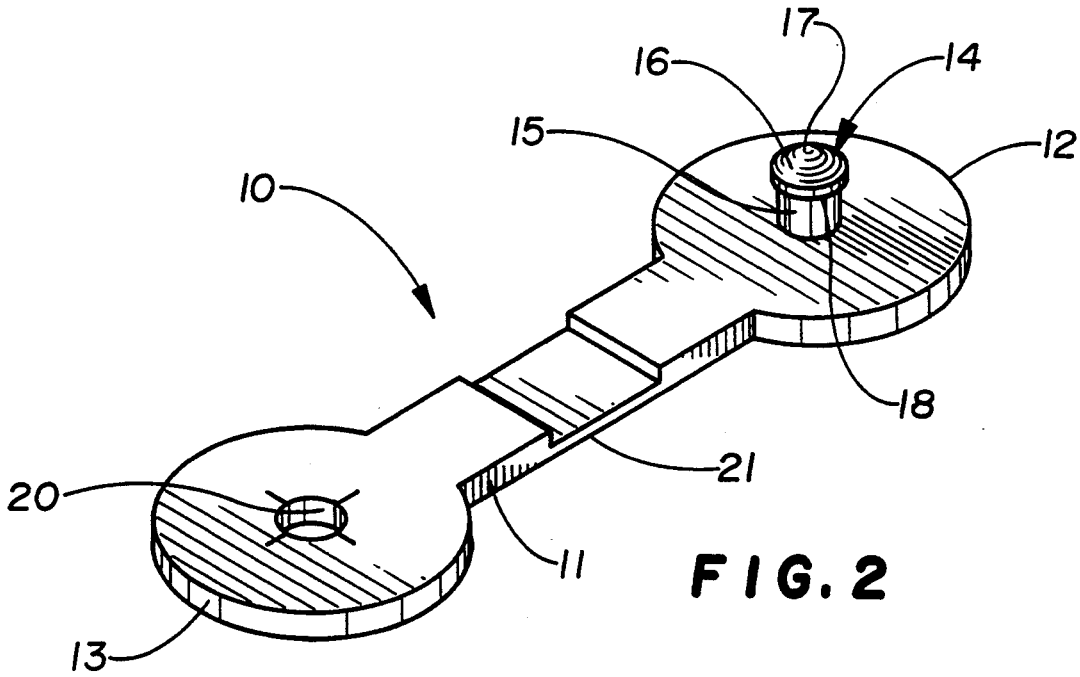
FIG. 2 is a perspective view of the present invention.
Figure 5:
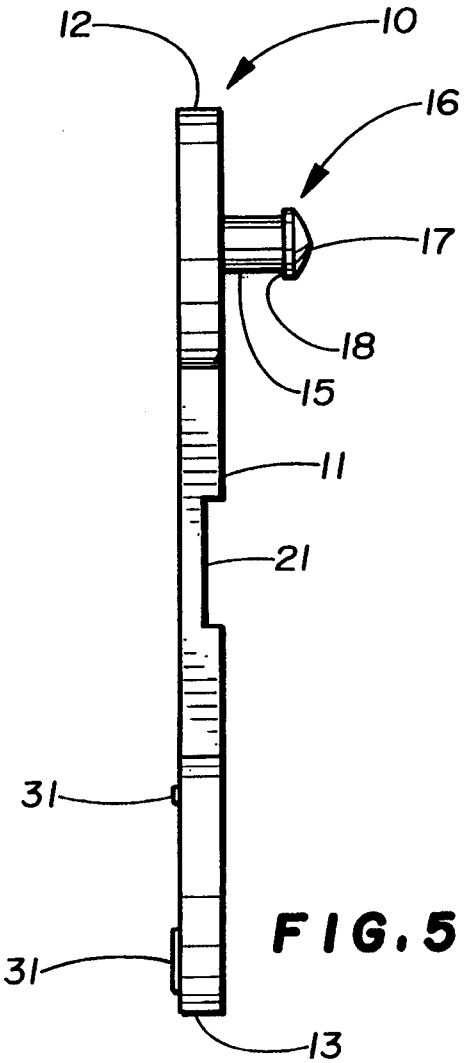
FIG. 5 is a side elevation view of the present invention.
Figure 4:
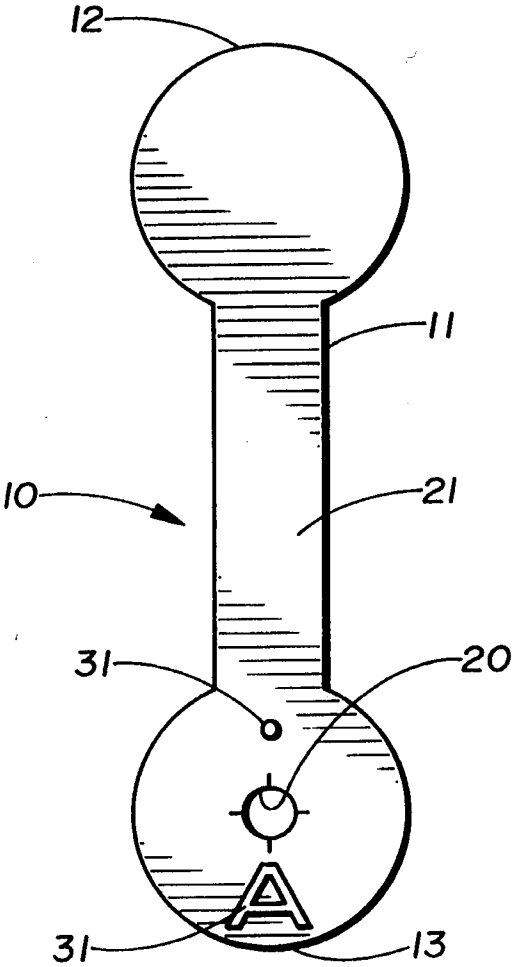
FIG. 4 is a bottom plan view of the present invention.
Figure 3:
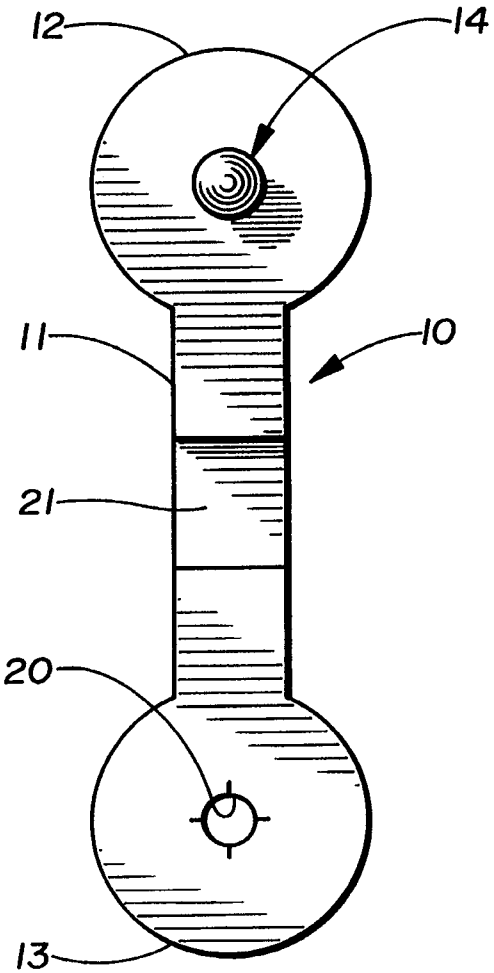
FIG. 3 is a top plan view of the present invention.
Figure 6:
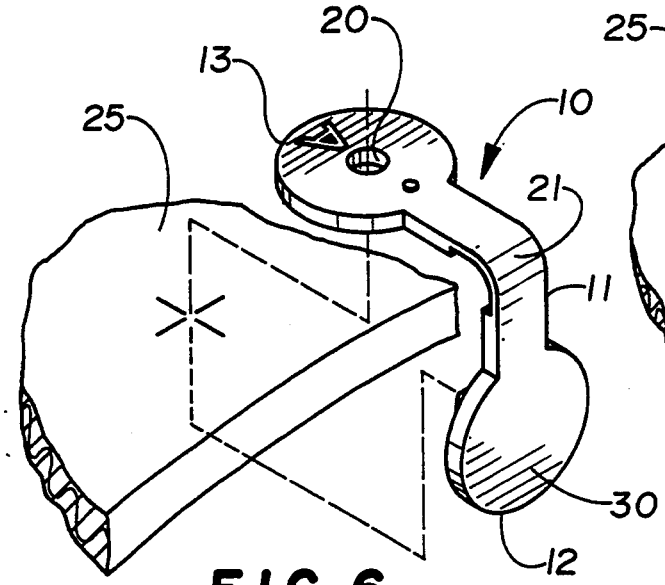
FIG. 6 is an exploded perspective view of showing the present invention being affixed to a sock.
Figure 7:
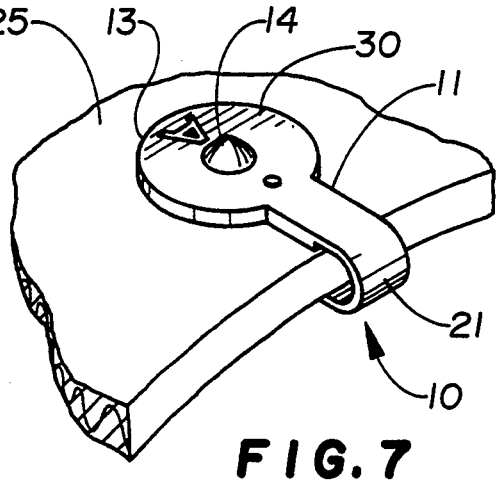
FIG. 7 is a perspective view showing the present invention affixed to the sock.
Figure 8:
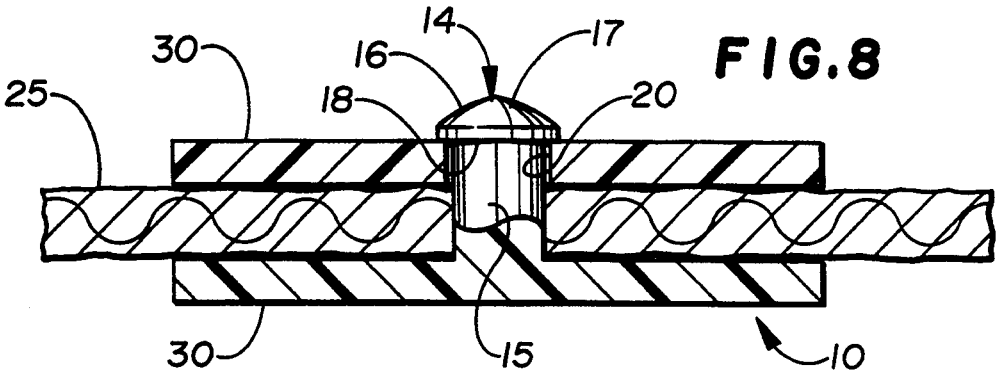
FIG. 8 is a cross-sectional view taken across the lines 8—8 of FIG. 1.
Figure 9:
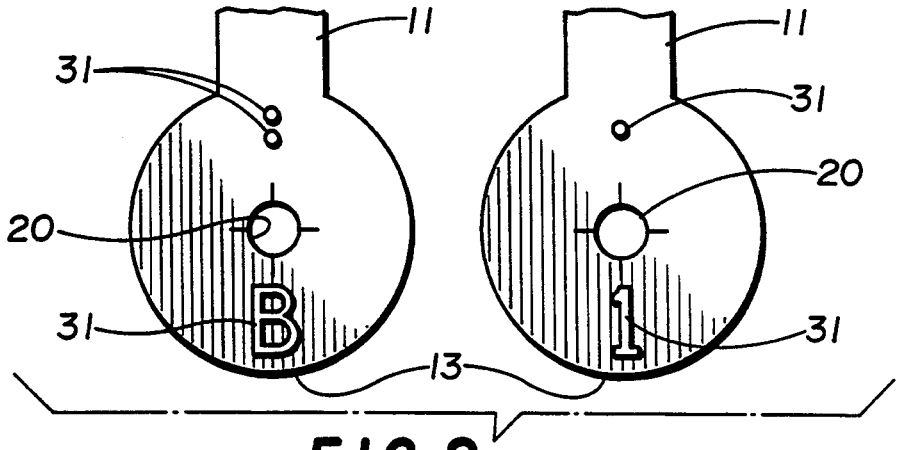
FIG. 9 is a partial bottom plan view showing various indicia means.

Referring now to FIGS. 1–9, the identifying device 10 of the present invention is a one piece unit which has a body 11, a first end 12 and an opposite second end 13. The first end 12 has a male member 14 formed thereon. The male member 14 has shaft 15 with a first end connected to the body 11 and a second end distal from the body 11. The second end of the shaft 15 has an enlarged portion 15 formed thereon. The enlarged portion 16 preferably is conical in shape with the apex 17 of the cone being distal from the body 11 of the device 10 and the base 18 of the cone being substantially perpendicular to the shaft 15 of the male member 14 for a connection as will be described. However, other configurations of the enlarged portion 16 may be used.

The second end 13 of the body 11 has a female member 20 formed thereon as an opening 20 near the second end 13. Preferably, the opening 20 has a cross section larger than the cross section of the shaft 15 of the male member 14 but smaller than the cross section of the base 18 of the enlarged portion 16 of the male member 14. In this manner, the enlarged portion 16 of the male member 14 may be forced through the opening 20 such that the apex 17 of the enlarged portion 16 guides the enlarged portion 16 through the opening 20 and the base of the enlarged portion secures the male member 14 to the female member 20 and prevents subsequent separation thereof.

The body 11 of the device 10 has a hinged means 21 between the first end 12 and the second end 13. Preferably, the device is formed from a sheet of flexible material such as plastic such that the body 11 may be easily folded to permit the male member 14 to be inserted into the female member 20.

To further facilitate folding the hinge, means 21 may be a portion of the body 11 which has a reduced cross section as compared to the ends of the body 11.

The device 10 is attached to a laundry item 25 by inserting the first end 12 of the body 11 into an opening in the laundry item 25 or by placing the first end 12 on the outer edge of the laundry item 25 such that the male member 14 is directed outwardly from the laundry item 25. As an example, if the laundry item 25 is a sock, the first end 12 of the body is placed in the open top of the sock with the male member oriented outwardly. The male member 12 is pushed through the laundry item 25 with the apex 16 of the enlarged portion 16 of the male member 14 facilitating penetration of the fabric of the laundry item 25. The body 11 is folded about the hinged means 21 and the female member 20 is joined to the male member 14. In this manner, the device 10 is irremovably affixed to the laundry item 25 with the shaft 15 of the male member 14 pressing through the laundry item 25. The wearer of the sock does not feel the identifying device since the flat surface of the body 11 is adjacent to the body of the wearer and the male member 14 is oriented outwardly from the body of the wearer. Also, pressure against the device 10, such as occurs when the wearer crosses his (or her) legs, does not produce any discomfort to the wearer as would occur if the device protruded inwardly of the sock. The device 10 is formed without sharp edges or burrs which might irritate or chafe the body of the wearer. The device 10 is attached to the laundry item 25 so that it is not visible when the item is worn.

On the outer surface 20 of the body 11 (i.e., the surface which is opposite from the laundry item 25 when the device 10 is attached to the laundry item 25) there is formed an indicia means 31. Preferably, the indicia means 31 is formed adjacent to the opening 20 near the second end 13 of the body 11. The indicia means 31 may be disposed between the opening 20 and the second end 13 of the body 11, between the opening 20 and the hinged means 21, or in both places. The indicia means 31 may be a letter of the alphabet, a number, a geometric design or combinations thereof. The indicia means 31 may be raised above the other surface 20, depressed into the outer surface 30 or coated on the outer surface. In addition, the indicia means 31 may be a color wherein the entire body 11 or a portion of the body 11 is colored.

The indicia means 31 serves to identify the laundry item 25. For those items such as socks, pillow cases, and other items which are normally pairs, the identical indicia means 31 are applied to the members of the pair so that the pair is more readily and rapidly identified. This is especially helpful for individuals who, for example, have several pairs of socks closely resembling one other in color (blue, navy blue,black) or pattern. It is particularly useful for persons who are illiterate, color blind or visually impaired. For the latter, braille indicia means 31 are provided. The indicia means 31 provide an additional advantage wherein, for example, one member of the family uses devices with one color (blue) and other member of the same family uses devices with a different color (white). Thus, the father can easily separate his socks from those of his son, who wears socks of a similar size. The indicia means facilitate separation and mating of laundry items 25 after washing the family laundry. The device 10 is not to keep the mated items together during washing as disclosed in the prior art, but is for simplified identification. Further, since the laundry items are not joined during laundering, there is no undue stress or tearing of the laundry items to which the device 10 is attached.

Due to the large number of indices and combination of indices which may be used, the device 10 has use for institutional applications.

The device 10 is easily attached to the laundry item 25 without special equipment. The device 10 can be attached to the laundry items 25 when initially purchased or at any time subsequently.

Preferably, a plurality of devices 10 having indicia means 31 (color, letter or number) are provided in a package or container. The devices 10 from the package are attached to the laundry items of one individual. As an example, a package may include devices 10 of one color (e.g., blue) with the letter "A" marked on a pair of devices 10, the letter "B" marked on another pair of devices, etc. Thus, a package with twenty-four (24) devices 10, including letters "A" through "L", would be used to identify twelve (12) pairs of socks of one individual. For other individuals, a package of devices 10 are provided having indicia means 31 (color and/or letter) which are different from those used by the one individual.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An identifying device for a pair of socks to permit proper pairing of the socks and to further identify an owner of the socks, the device comprising:

a pair of male members, each having a central post formed thereon, the central post having an enlarged tapered head, each male member being disposed inside the respective sock of the pair of socks such that the central post extends through the respective sock, a pair of female members, each having a central opening therein, each female member being disposed outside the respective sock of the pair of socks such that the central post on the male member attached to the respective sock is received with a friction fit in the central opening in the female member disposed outside each respective sock, and the respective male member is connected to the respective female member with the respective sock therebetween, and each female member having a periphery, a first surface and a second opposite surface, the first surface being disposed adjacent to the respective sock, indicia means formed on the second surface of each female member to permit identification of the owner of the pair of socks and to permit matching pairs of socks, said indicia means being formed between the central opening and the periphery of each female member and visible when the respective male member is connected to the respective female member.

2. The identifying device of claim 1, further comprising a strap formed between one of the male members and one of the female members wherein said members are connected, the strap being folded around an edge of one of the socks when said members are attached to the respective sock.

* * * * *